United States Patent [19]

Ghiardo

[11] Patent Number: 5,016,681

[45] Date of Patent: May 21, 1991

[54] ELECTROMAGNETIC BLOCKING UNIT FOR A WEFT STORAGE DRUM

[75] Inventor: Fiorenzo Ghiardo, Vigliano Biellese, Italy

[73] Assignee: ROJ Electrotex S.p.A., Biella, Italy

[21] Appl. No.: 421,933

[22] Filed: Oct. 16, 1989

[30] Foreign Application Priority Data

Oct. 14, 1988 [IT] Italy ..... 22324 A/88

[51] Int. Cl.[5] ..... D03D 47/36

[52] U.S. Cl. ..... 139/452; 335/256; 335/257

[58] Field of Search ..... 66/219; 139/455, 452; 335/256, 257; 242/47.01

[56] References Cited

U.S. PATENT DOCUMENTS

| | | | |
|---|---|---|---|
| 778,021 | 12/1904 | Feingold | 335/256 X |
| 2,246,855 | 6/1941 | Miessner . | |
| 3,235,777 | 2/1966 | Hatashita | 335/256 X |
| 4,486,728 | 12/1984 | Hastings et al. | 335/256 |
| 4,632,155 | 12/1986 | Maina | 139/452 |

FOREIGN PATENT DOCUMENTS

| | | |
|---|---|---|
| 0174039 | 3/1986 | European Pat. Off. . |
| 885121 | 12/1961 | United Kingdom . |

*Primary Examiner*—Andrew M. Falik

*Attorney, Agent, or Firm*—Young & Thompson

[57] ABSTRACT

An electromagnetic unit coacts with the winding drum of a weft feeding device to control unwinding of weft yarn from the drum. The electromagnetic unit comprises a movable stem surrounded by a pair of adjacent coaxial electromagnetic coils. Energization of one coil causes the stem to move into a position where it blocks unwinding of the yarn, whereas energization of the other coil retracts the stem and permits free unwinding of the yarn.

5 Claims, 3 Drawing Sheets

ELECTROMAGNETIC BLOCKING UNIT FOR A WEFT STORAGE DRUM

BACKGROUND OF THE INVENTION

The present invention concerns improvements in measuring weft feeders for fluid jet looms (air or water looms), namely in those special weft yarn feeders for looms wherein the weft yarn, wound to form a reserve on a drum held stationary, is drawn by the loom with the help of a main nozzle and is measured, during its unwinding from said drum, by counting the turns drawn. Such weft feeders comprise an electromagnetic blocking unit, having a stem which is electromagnetically controlled to contact the edge of the drum, so as to stop the yarn from unwinding by engaging the same laterally.

More specifically, the present invention concerns an electromagnetic unit to block the weft yarn in said measuring weft feeders.

It is known that the performances demanded nowadays from an electromagnetic unit to block the weft yarn in measuring weft feeders are very high, and that the results obtained up to date with the already known units are by no means satisfactory, in that the conventional devices do not have characteristics answering the ever increasing requirements of modern weaving. In fact, a blocking unit of the type in question is required—in order to be really satisfactory—to perform over one thousand operations per minute, and to have a life corresponding to hundreds of millions of operations with no need for maintenance, an operating time below 5 ms with a stroke of at least 3–4 mm, and a high precision as to the exact moment at which the weft yarn is released. Furthermore, the magnet core of such unit has to be prevented from undergoing strong recoils (in practice, the recoils should not exceed 10% of its stroke) both in one direction and in the other.

In the event that the weft feeder should use a single electromagnetic unit to block the weft yarn—as is often the case, for reasons of simplicity and economy of construction—it has been found very appropriate to use said unit with the stem stopping the yarn from unwinding while the magnet is not energized. The use of a conventional electromagnetic unit, with a single coil attracting the core (and thus the stem) in order to block the weft yarn, involves in this case the need for the stem to return in the rest position by means of a spring, which latter should be sufficiently strong to reach the required operation speeds, but capable on the other hand to guarantee fairly contained recoils of the stem. It is needless to underline the difficulty of producing a spring with these characteristics: in fact, the use—in units of this type—of a spring for returning the stem in a weft yarn blocking position (rest condition of the electromagnetic unit) after the coil has been energized, involves on the one hand a high energizing time, since part of the force developed on the core is absorbed so as to actually win the resistance of the spring, and on the other hand it always determines, on reaching the blocking position after the coil has been de-energized, fairly strong recoils of the stem, which may cause even serious weft measuring errors, since the weft yarn will most likely pass under the stem just when this latter recoils.

It should be noted that these recoils, as the stem reaches its blocking position, are not easy to prevent, since the spring of the electromagnetic unit, as opposed to its coil, develops its minimum force on the stem just at the end of the stroke, when it is practically released and namely when the stem has to stop by striking against the inner stop. The use of even effective expedients, like that object of the Italian Utility Model application No. 22990 B/86 of the same Applicant, has limited this drawback, but has not allowed to reduce the recoils of the stem of the blocking unit to less than 10% its stroke, as it instead appears more and more indispensable for the most efficient working of measuring weft feeders in modern looms.

SUMMARY OF THE INVENTION

The present invention now proposes to supply an electromagnetic unit to block the weft yarn in measuring weft feeders which, by overcoming all the aforementioned drawbacks of known technique, is adapted to fully satisfy the requirements of the manufacturers of modern and very fast water or air jet looms.

Said unit—of the type comprising a stem movable along its axis, electromagnetically controlled so as to engage the weft yarn laterally with its free end and stop its unwinding from the weft feeder drum—is characterized in that it comprises a pair of adjacent electromagnetic coils having the same axis, and in that the energizing of one coil causes the stem to move towards the weft feeder drum, so as to block the weft yarn, while the energizing of the other coil causes the stem to move away from said drum, so as to release the previously blocked weft yarn.

In practice, the stem of said electromagnetic unit preferably comprises an elongated body of non-magnetic material, ending with a blocking rod covered by a metal cap, and a hollow cylinder of magnetic material, coaxially enveloping said elongated body so as to form a common core for the two adjacent coils of the electromagnetic unit.

The electromagnetic blocking unit, according to the invention, furthermore preferably comprises spring means to keep the stem in a position blocking the weft yarn when the coils are de-energized, while said adjacent coils having the same axis are surrounded by a ferromagnetic armature, which separates them and forms stops for the movements of the stem, between said stops and the corresponding stops of the stem there being interposed dampening washers.

The electromagnetic unit, according to the invention, is moreover formed in such a way that the reluctance of the magnetic circuit of each of said two adjacent coils having the same axis and a common core, is minimum in correspondence of the end of the stroke of the stem controlled by said coils.

BRIEF DESCRIPTION OF THE DRAWINGS

A currently preferred embodiment of the electromagnetic blocking unit according to the invention will now be described in detail, by mere way of example, with reference to the accompanying drawings, in which.

DESCRIPTION OF THE PREFERRED EMBODIMENT

Figure 2:
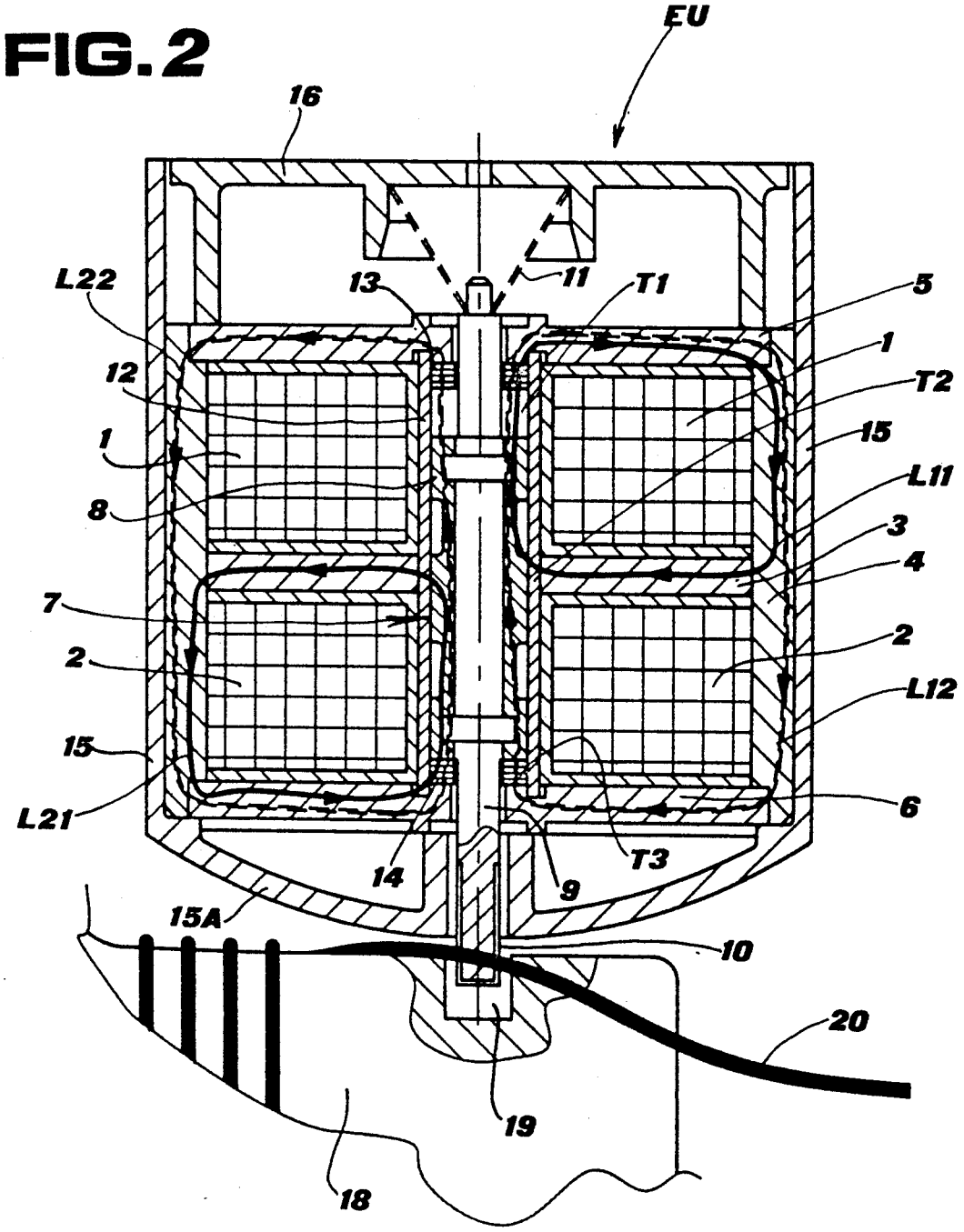
FIG. 2 shows a section of the electromagnetic blocking unit according to the invention, applied to the weft feeder of FIG. 1, evidencing the main flow lines in the magnetic circuit of said unit (the right side of the figure showing the flow lines which develop when the coil moving the stem away from the drum and releasing the weft yarn is energized, while on the left side are shown the flow lines which develop when the coil moving the stem towards the drum and blocking the weft yarn is energized)

Referring, first of all, to FIG. 2 of the drawings, it can be seen how the electromagnetic unit EU, according to the invention, comprises two adjacent coils having the same axis, and precisely a coil 1 to release the weft yarn and a coil 2 to control the blocking of the weft yarn. The two coils 1 and 2 are separated by an iron disc 3 and are enveloped by a cylindrical hollow body 4 of iron and by two discs 5 and 6, also of iron. The unit moreover comprises a movable stem 7, which is formed of an elongated body of non-magnetic material, preferably plastic material for purposes of lightness, the central part of which is enveloped by a hollow cylinder 8 of iron, rigidly connected thereto. The elongated body of non-magnetic material of the stem 7 terminates, at its working end, with a blocking rod 9, projecting beyond the stop coil 2 and covered by a cap 10, preferably of metallic material adapted to resist to the abrasion caused by the sliding of the weft as it stops. On the side of the release coil 1, the stem 7 engages with its end opposite to the rod 9 a tapered helical spring 11, the only purpose of which is to keep in the stop position the movable stem 7 which has been previously carried to said position, even if the electromagnetic unit is de-energized and in an overturned position. The action of the spring 11 is fairly weak, as it must possibly oppose only the force of gravity applied to the movable stem 7.

The movable stem 7 is free to slide in the axial sense and its only guide consists of a hollow cylinder 12 of non-magnetic material, preferably plastic material suited for the purpose. The stroke of the movable stem 7 is limited by the contact of the two heads of its hollow cylinder 8 against two dampening end washers 13, on the side of the coil 1, and 14, on the side of the coil 2. As seen in FIG. 2, the coils 1 and 2 are surrounded by a ferromagnetic armature 4, 5, 6, the discs 5 and 6 of which define stops bearing the dampening end washers 13. In operation of the device, the washers 13 contact corresponding stops formed at opposite ends of the hollow cylinder 8.

The whole of the electromagnetic unit is contained in a shell 15 closed by a cover 16.

Figure 1:
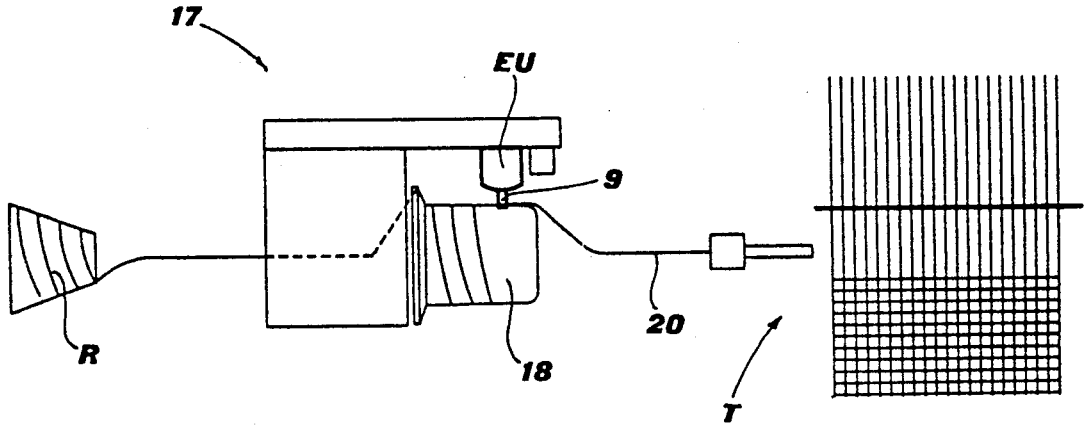
FIG. 1 diagrammatically illustrates a measuring weft feeder equipped with the unit according to the invention.

In FIGS. 1 and 2, the electromagnetic unit EU is fixed, by way of a suitable support (not shown), externally to the drum 18 (forming the winding unit of a weft feeder 17, fed by a spool R and feeding a fluid jet loom T), so that the rod 9 of the stem 7, protected by the cap 10, may occupy, in stop conditions—with no current in the coils 1 and 2—the free space between said drum 18 and the bottom 15A of the shell 15 of the unit EU, partially penetrating into the hole 19 (FIG. 2) formed on the drum 18. In these conditions, as soon as the weft yarn 20 hits the side of the cap 10 of the stem 7 of the electromagnetic unit, the unwinding of the turns from the weft feeder drum 18 stops at once.

Figure 3:
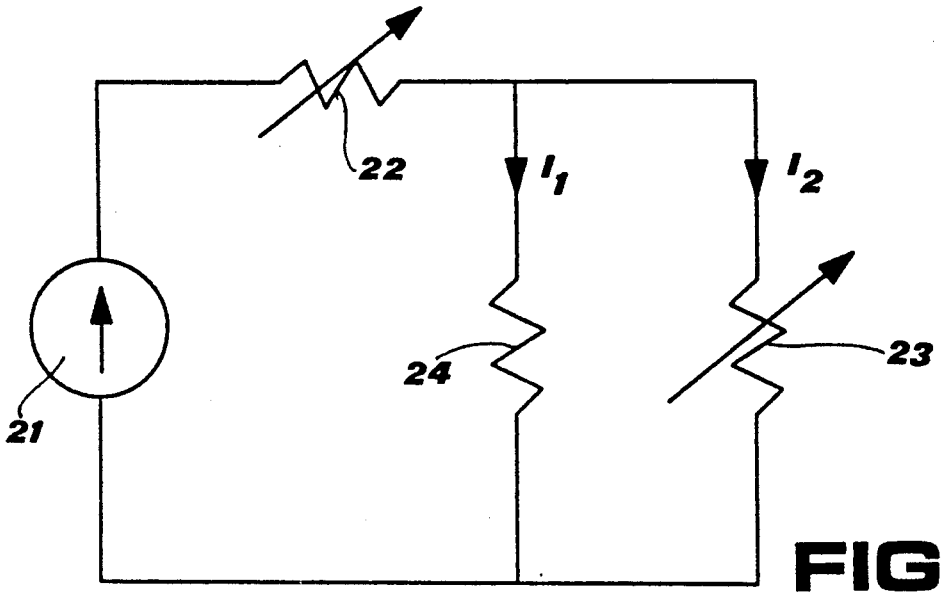
FIGS. 3 and 4 are equivalent diagrams of the magnetic circuit of the coils of the unit in the two cases of energizing one and the other coil respectively.

The path of the flow lines in the magnetic circuit of the unit EU, when the release coil 1 is energized, is shown on the right side of FIG. 2 by lines L11 and L12. The flow lines L11 must cross in their path two main air gaps: the air gap T1, between the cylinder 8 and the disc 5, and the air gap T2, between the cylinder 8 and the disc 3. The flow lines L12 must equally cross two main air gaps: again the air gap T2, like the lines L11, and furthermore the air gap T3, between the cylinder 8 and the disc 6. FIG. 3 shows the equivalent diagram of the magnetic circuit, merely for what concerns the magnetic reluctances of the air gaps T1, T2 and T3. The voltage generator 21 represents the magnetomotive force generated by the coil 1 when current circulates therein. The variable resistance 22 represents the reluctance through T1, which depends on the position of the stem 7 and linearly decreases while said stem travels towards the position of release (as the cylinder 8 approaches the disc 5 and the air gap T1 is reduced). Likewise, the variable resistance 23 represents the reluctance through T3, which reluctance increases while the stem 7 travels towards the position of release (as the cylinder 8 moves away from the disc 6 and the air gap T3 increases). The resistance 24 represents instead the magnetic reluctance through T2, which does not vary during motion of the stem 7. The currents $I_1$ and $I_2$ represent the flows L11 and L12 and their sum represents the total flow of the magnetic circuit. This latter is proportioned in such a way that said flow, i.e. the sum $I_1+I_2$, increases when the stem 7 moves towards the position of release. The force generated on the stem is proportional to the variation of the flow; and the flow variation increases all the more as one gets closer to the extreme position of release. Thus, when the stem 7 stops against the dampening washer 13 and is driven back, due to the elasticity of this latter, towards the stop position, the elastic force is efficiently opposed by the magnetic force of the coil 1, which is, in this condition, of maximum intensity: in this way, the recoil effect is effectively limited to values below 10% of the stroke.

To keep the stem in its position of release, it is necessary for the current to be kept through the coil 1.

The same phenomenon takes place, specularly, when the stop coil 2 is energized, save for the fact that, thanks to the presence of the spring 11, it is not necessary to keep current circulating through the coil 2 in order to hold the stem 7 in its blocking position.

Figure 4:
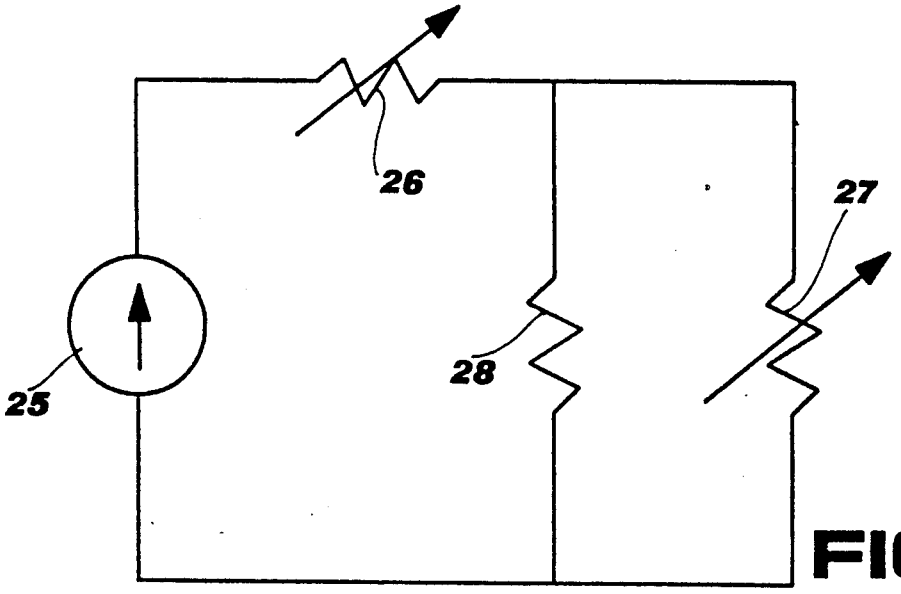

The left part of FIG. 2 shows the path of the flow lines L21 and L22, when the stop coil 2 is energized, through the usual air gaps T1, T2, T3. FIG. 4 shows the equivalent diagram of the corresponding magnetic circuit, which comprises a voltage generator 25, two variable resistances 26 and 27 corresponding to the magnetic reluctances through, respectively, T3 and T1, and a resistance 28 corresponding to the reluctance through T2. The resistance 26 decreases and the resistance 27 increases when the stem 7 moves towards the blocking position.

During normal use, the coil 1 of the electromagnetic unit EU is energized when the weft yarn has to be released and for the whole time of its insertion into the loom shed. As a predetermined number of turns has been counted, the coil 1 is de-energized and the coil 2 is energized for a length of time sufficient to move the rod 9 of the stem 7 to the position in which the yarn 20 is blocked, and to provide for dampening the recoils.

It is understood that the illustrated embodiment of the invention is a mere example and that it may hence be obtained with variants and modifications in respect of the unit of FIGS. 1 and 2, without thereby departing from the scope of the present invention.

I claim:

1. In combination with a weft feeding device winding drum, an electromagnetic unit comprising a stem movable along its axis to a first position laterally engaging a weft yarn on said drum to stop unwinding thereof, and a second position permitting free unwinding thereof, said electromagnetic unit further comprising first and second adjacent coaxial electromagnetic coils, energization of said first coil moving said stem to said first position and energization of said second coil moving said stem to said second position wherein the electro magnetic coils are adapted to reduce any recoils of the stem as it reaches its first position.

2. Apparatus according to claim 1, wherein said stem comprises an elongated body of non-magnetic material, having a weft yarn-engaging end comprising a blocking rod covered by a metal cap, said stem being provided centrally with a hollow cylinder of magnetic material coaxially enveloping said elongated body so as to form a common core for said first and second electromagnetic coils.

3. Apparatus according to claim 1, further comprising spring means urging said stem to said first position when said first and second electromagnetic coils are de-energized.

4. Apparatus according to claim 1, further comprising a ferromagnetic armature surrounding said first and second electromagnetic coils, said armature defining stops limiting movement of said stem to said first position and to said second position, dampening washers being positioned on said stops.

5. Apparatus according to claim 2, wherein each of said first and second electromagnetic coils is so dimensioned and disposed within said unit as to be characterized by a magnetic circuit having a magnetic reluctance which is minimum when said stem reaches said first or said second position.

* * * * *